US011505439B2

(12) United States Patent
Eftimie

(10) Patent No.: US 11,505,439 B2
(45) Date of Patent: Nov. 22, 2022

(54) FLANGE CASTING WIRELINE DRUM

(71) Applicant: NOV CANADA ULC, Calgary (CA)

(72) Inventor: Gheorghe Eftimie, Calgary (CA)

(73) Assignee: NOV CANADA ULC, Calgary (CA)

( * ) Notice: Subject to any disclaimer, the term of this patent is extended or adjusted under 35 U.S.C. 154(b) by 498 days.

(21) Appl. No.: 16/418,136

(22) Filed: May 21, 2019

(65) Prior Publication Data

US 2020/0199943 A1 Jun. 25, 2020

Related U.S. Application Data

(60) Provisional application No. 62/783,639, filed on Dec. 21, 2018.

(51) Int. Cl.
*B66D 1/30* (2006.01)
*E21B 19/00* (2006.01)

(52) U.S. Cl.
CPC ..... *B66D 1/30* (2013.01); *E21B 19/008* (2013.01)

(58) Field of Classification Search
CPC ..... B66D 5/10; B66D 1/30; E21B 19/008; B65H 75/14; B65H 75/2245
See application file for complete search history.

(56) References Cited

U.S. PATENT DOCUMENTS 1,269,003 A * 6/1918 Riggs ..... B65H 75/14 242/610.1
2,130,265 A * 9/1938 Clinton ..... B65H 75/14 242/611.2
3,784,166 A * 1/1974 Renfroe ..... B65H 75/14 254/334
3,949,085 A 2/1976 Campbell
4,198,012 A 4/1980 Debellis et al.
4,210,295 A * 7/1980 Brusselle ..... B66D 1/34 242/125.1
4,753,399 A * 6/1988 Baum ..... B66D 1/30 242/118.4

(Continued)

FOREIGN PATENT DOCUMENTS

FR 2617148 A1 12/1988

OTHER PUBLICATIONS

FR2617148A1 Translation, espacenet.com (Year: 2022).*

(Continued)

*Primary Examiner* — Sang K Kim
*Assistant Examiner* — Nathaniel L Adams
(74) *Attorney, Agent, or Firm* — Schwegman Lundberg & Woessner, P.A.

(57) ABSTRACT

The present disclosure relates to a wireline drum configured for use in a material handling system. The wireline drum may have a core extending between a pair of flanges. The core may be configured to receive a spooled wireline. Each flange may have a neck extending from an inner surface toward the core and configured to nestably engage the core. The present disclosure further relates to methods of manufacturing such a wireline drum. In some embodiments, each flange, including the flange neck, may be cast as substantially a single component. At a joint between each flange neck and the core, a V-shaped groove may be defined for receiving a weld. Each flange may be welded to the core at the V-shaped groove.

20 Claims, 11 Drawing Sheets

(56) References Cited

U.S. PATENT DOCUMENTS

| | | | | |
|---|---|---|---|---|
| 5,035,355 | A * | 7/1991 | Dollhopf | B65H 75/14 228/104 |
| 9,316,067 | B1 | 4/2016 | Lu et al. | |
| 2011/0240791 | A1* | 10/2011 | Lindley | B65H 75/14 242/609 |
| 2014/0284108 | A1* | 9/2014 | Pendleton | E21B 19/008 175/57 |

OTHER PUBLICATIONS

"International Application Serial No. PCT/CA2019/000167, International Search Report dated Mar. 3, 2020", 3 pgs.
"International Application Serial No. PCT/CA2019/000167, Written Opinion dated Mar. 3, 2020", 4 pgs.
"International Application Serial No. PCT/CA2019/000167, International Preliminary Report on Patentability dated Jun. 16, 2021", 6 pgs.

* cited by examiner

FLANGE CASTING WIRELINE DRUM

CROSS-REFERENCE TO RELATED APPLICATION

This patent application claims the benefit of U.S. Provisional Patent Application No. 62/783,639, filed Dec. 21, 2018, entitled "FLANGE CASTING WIRELINE DRUM", which is incorporated by reference herein in its entirety.

FIELD OF THE INVENTION

The present disclosure relates to novel and advantageous handling systems. In particular, the present disclosure relates to handling systems in which a wireline conductor cable or slickline is spooled around a drum's core. More particularly, the present disclosure relates to a wireline drum having cast flanges welded to a core and methods of manufacturing the same.

BACKGROUND OF THE INVENTION

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

A handling system for a mast or derrick typically includes a wireline conductor cable or slickline used to raise and lower downhole tools inside the well through a lubricators' stack. The downhole tools may be suspended below a crown sheave or stuffing box sheave via a plurality of outgoing and returning portions of the wireline cable that is reeved through one or more spooling sheaves and/or redirect sheaves. Raising and lowering of the downhole tools may be controlled by rotating the drum to spool and unspool the wireline conductor cable or the slickline. Due to the reeving arrangement between the sheaves, in order to raise and lower the downhole tools at a given speed, the wireline conductor cable or the slickline may spool on and off the wireline drum at a relatively high speed. In some cases, the wireline cable or slickline may be spooled on and off the drum at speeds of about 15 to 17 mph.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to a handling system including a crown sheave or stuffing box sheave arranged over a well so as to direct a line toward the well, and a wireline cable extending around the crown sheave or stuffing box sheave, the wireline cable configured for coupling to a downhole tool. The system may also include a wireline drum configured for spooling and unspooling the wireline cable to control movement of the traveling block. The wireline drum may include a core having a first diameter adapted for having the wireline cable spooled thereon. The wireline drum may also include a pair of cast flanges where each flange is arranged at an end of the core and includes a disk portion having a second diameter larger than the first diameter. Each flange may also include a neck extending from the disk portion toward the core.

The present disclosure, in one or more embodiments, relates to a wireline drum configured for receiving a spooled wireline. The drum may include a core having a first diameter and configured for receiving a wireline spooled thereon. The drum may also include a pair of cast flanges, each flange arranged at an end of the core and comprising a disk portion having a second diameter larger than the first diameter, and a neck extending from the disk portion toward the core.

The present disclosure, in one or more embodiments, may also include a method of manufacturing a wireline drum. The method may include a assembling a core where the core has a first diameter and is configured for receiving a wireline spooled thereon. The method may also include casting a pair of flanges where each flange includes a disk portion having a second diameter larger than the first diameter and a neck extending from the disk portion. The method may also include welding each flange to the core by placing a weld between the core and each neck portion.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure relates to a wireline drum configured for use in a material handling system. In particular, the present disclosure relates to a wireline drum having a core extending between a pair of flanges. The core may be configured to receive a spooled wireline. Each flange may have a neck extending from an inner surface toward the core and configured to nestably engage the core. The present disclosure further relates to methods of manufacturing such a wireline drum. In some embodiments, each flange, including the flange neck, may be cast as substantially a single component. At a joint between each flange neck and the core, a V-shaped groove may be defined for receiving a weld. Each flange may be welded to the core at the V-shaped groove.

Figure 1A:
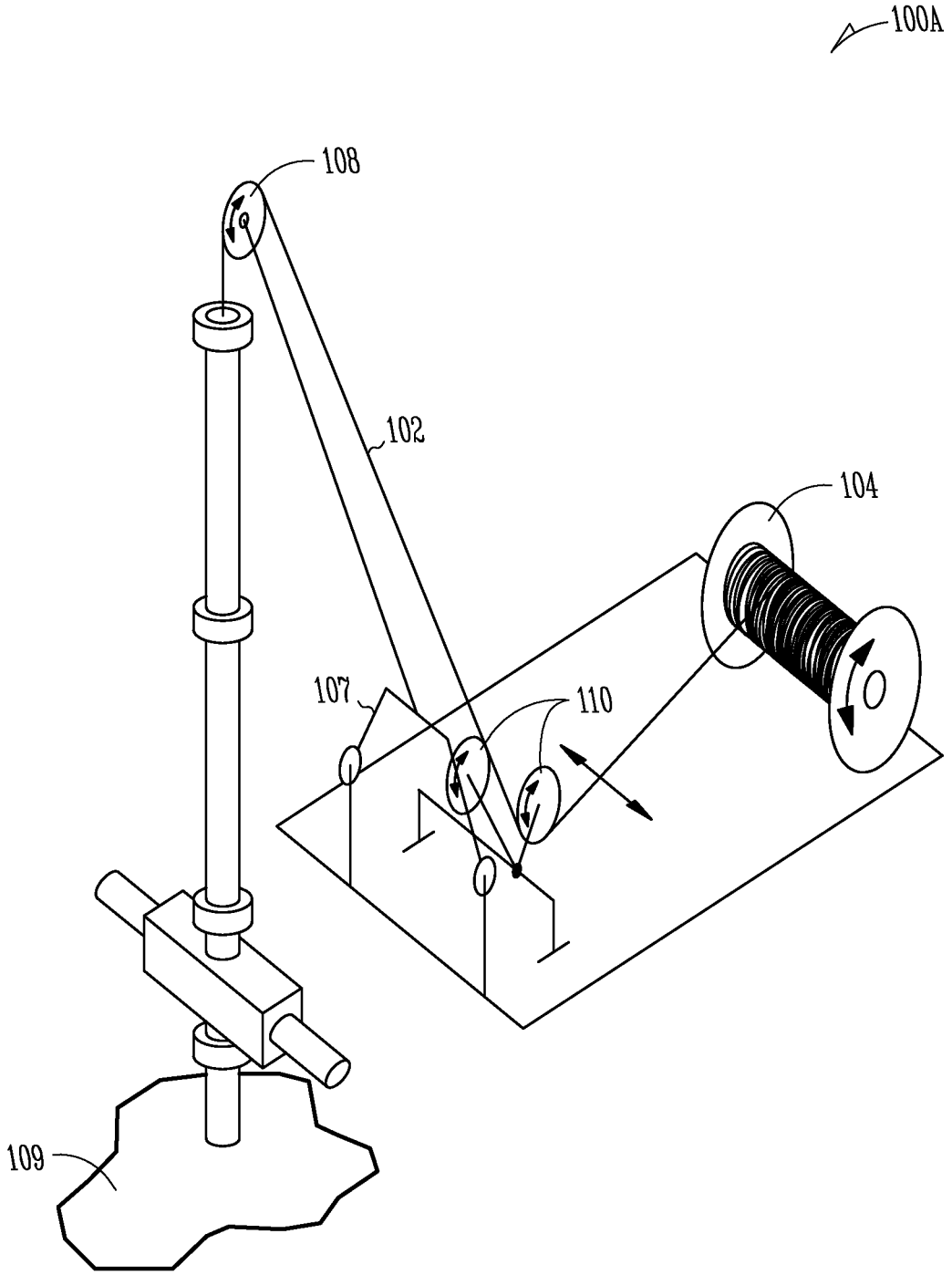
FIG. 1A is a conceptual drawing of a wireline operation with a wireline conductor cable or slickline extending from a wireline drum and reeved through a plurality of sheaves, according to one or more embodiments.
Figure 1B:
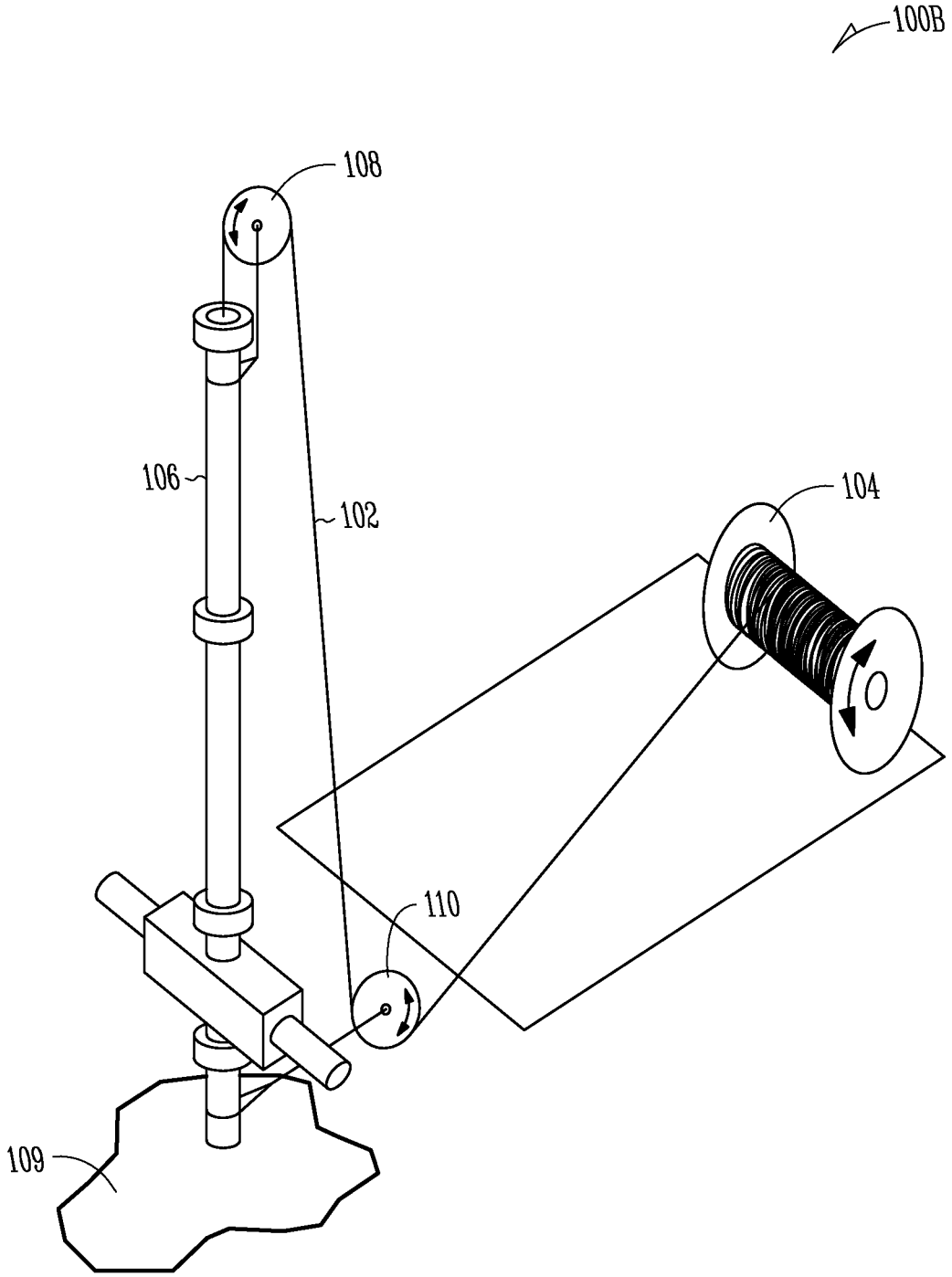
FIG. 1B is a conceptual drawing of another wireline operation with a wireline conductor cable or slickline extending from a wireline drum and reeved through a plurality of sheaves, according to one or more embodiments.

Turning now to FIGS. 1A and 1B, handling systems 100*a* and 100*b* are shown, according to some embodiments. For each system 100*a*, 100*b*, a wireline 102 may be spooled, beginning at a first end of the wireline, around a rotatable wireline drum 104. The wireline 102 may extend from the drum 104 toward one or more sheaves 110, which may include spooling and/or redirect sheaves. A crown sheave 108 or stuffing box sheave may be arranged at the top of a mast/derrick 107 (as shown in FIG. 1A) or at the top of a lubricators' stack 106 (as shown in FIG. 1B). The wireline 102 may be reeved between the crown sheave 108 and spooling or redirect sheaves 110. While not shown in FIGS. 1A and 1B, in some embodiments, a second end of the wireline 102 may extend from the crown sheave 108 into a well 109 to one or more downhole tools. The wireline 102 may be spooled and unspooled from the drum 104 in order to move the downhole tools inside the well 109 toward and away from the crown sheave 108. It is to be appreciated that the wireline 102 may move relatively fast, at speeds of up to 15 or 17 miles per hour, for example, and may experience tensile loading of up to 9,000 lbf.

The wireline drum 104 may be arranged within, or as part of, a drawworks assembly and may be driven by a planetary gear, a chain and sprocket, or another suitable drive mechanism. The wireline drum 104 may be designed and constructed so as to withstand stresses caused by lateral wrapping of the wireline 102 across the drum as it is spooled and unspooled, stresses caused by tension on the line, as well as stresses caused by the relatively high speed rotation of the drum. The wireline drum 104 may generally include a core arranged between a pair of flanges. In some embodiments, welding may be used to couple the flanges to the core. In other embodiments, other suitable coupling mechanisms may be used to couple the flanges to the core. In still other embodiments, the wireline drum 104 may be cast with a core and flanges as a single cast element.

Figure 2:
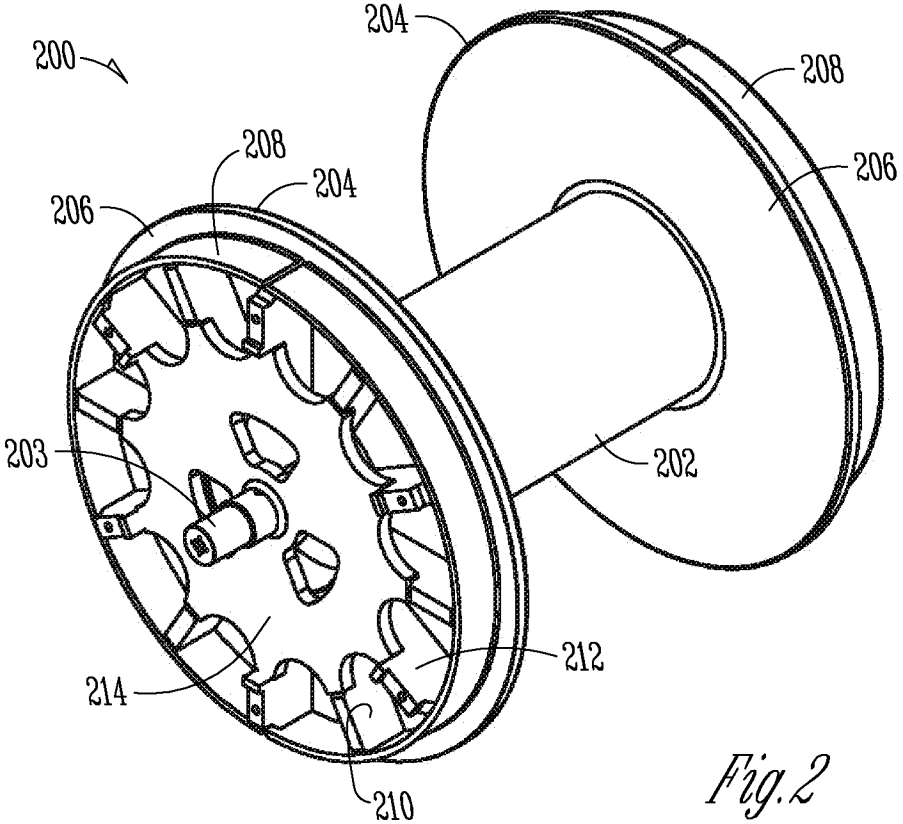
FIG. 2 is a perspective view of a wireline drum, according to one or more embodiments.
Figure 3:
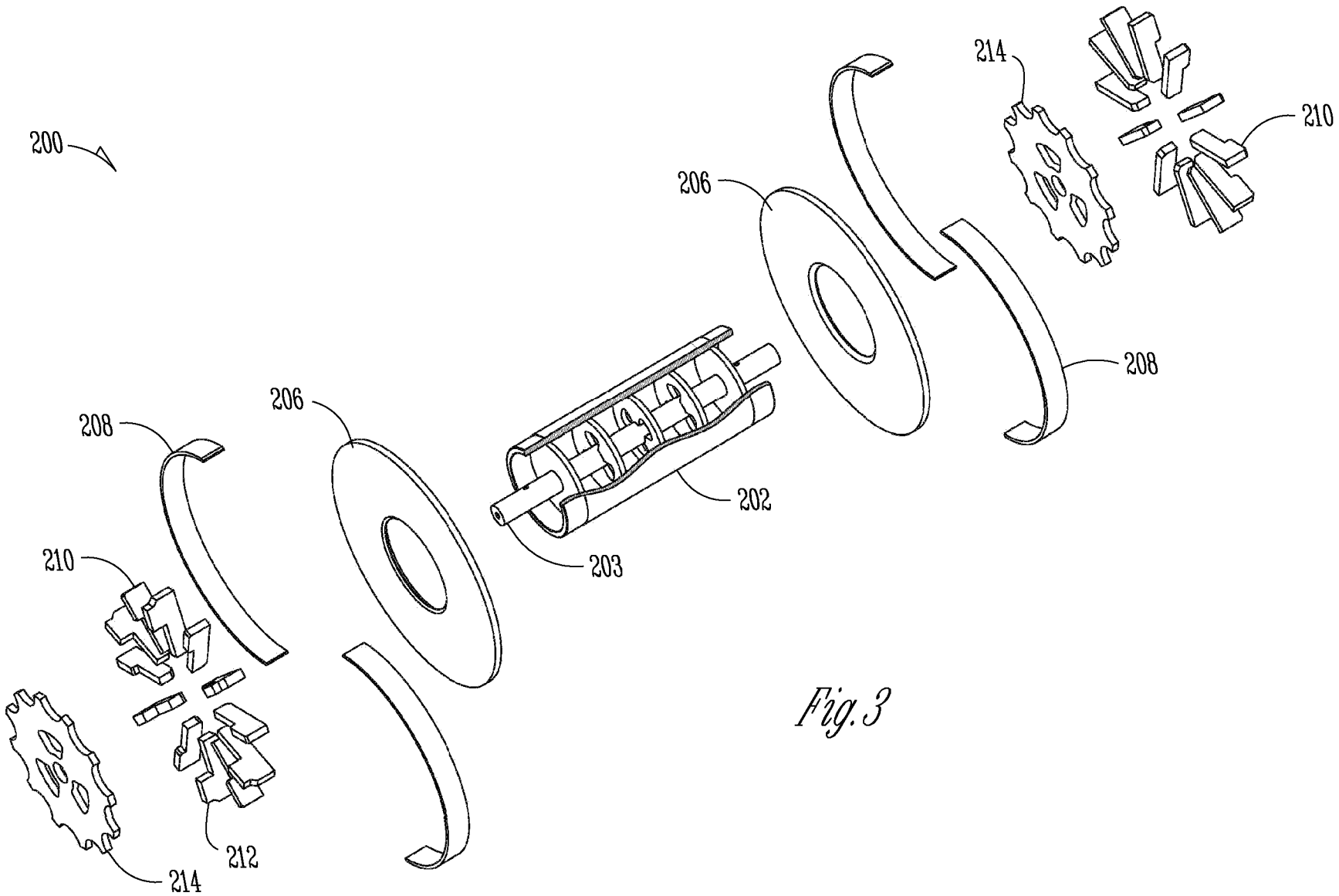
FIG. 3 is an exploded view of the wireline drum of FIG. 2, according to one or more embodiments.

FIG. 2 shows one example of a wireline drum 200 having a core 202 arranged between a pair of flanges 204, according to one or more embodiments. FIG. 3 shows an exploded view of the drum 200 with an internal view of the core 202. The core 202 and flanges 204 may be arranged about a central shaft 203. The core 202 may have a cylindrical shape and may be configured to receive a spooled wireline. Each flange 204 may include a disk portion 206, a brake ring 208, and a plurality of gussets, which may include brake gussets 210 and/or sprocket gussets 212. The disk portion 206 may be configured to provide an extended surface perpendicular to the core 202 so as to maintain a position of a wireline spooled on the core. The brake ring 208, which may include two or more sub-portions, may have a circular shape and may be configured to receive a band brake for controlling rotational speed of the drum 200. The brake gussets 210 may provide stiffening support to the brake ring 208. The sprocket gussets 212 may be configured to extend outward from the flange 204 and may be configured for coupling to a drive sprocket. The various components of each flange 204 may be individually welded or otherwise individually secured to assemble the flange. In particular, each of the brake ring 208, brake gussets 210, and sprocket gussets 212 may be welded to the disk portion 206. In some embodiments, the flange 204 may additionally have an endcap 214, which may be welded to the gussets 210/212 and/or to the disk portion 206.

Figure 4:
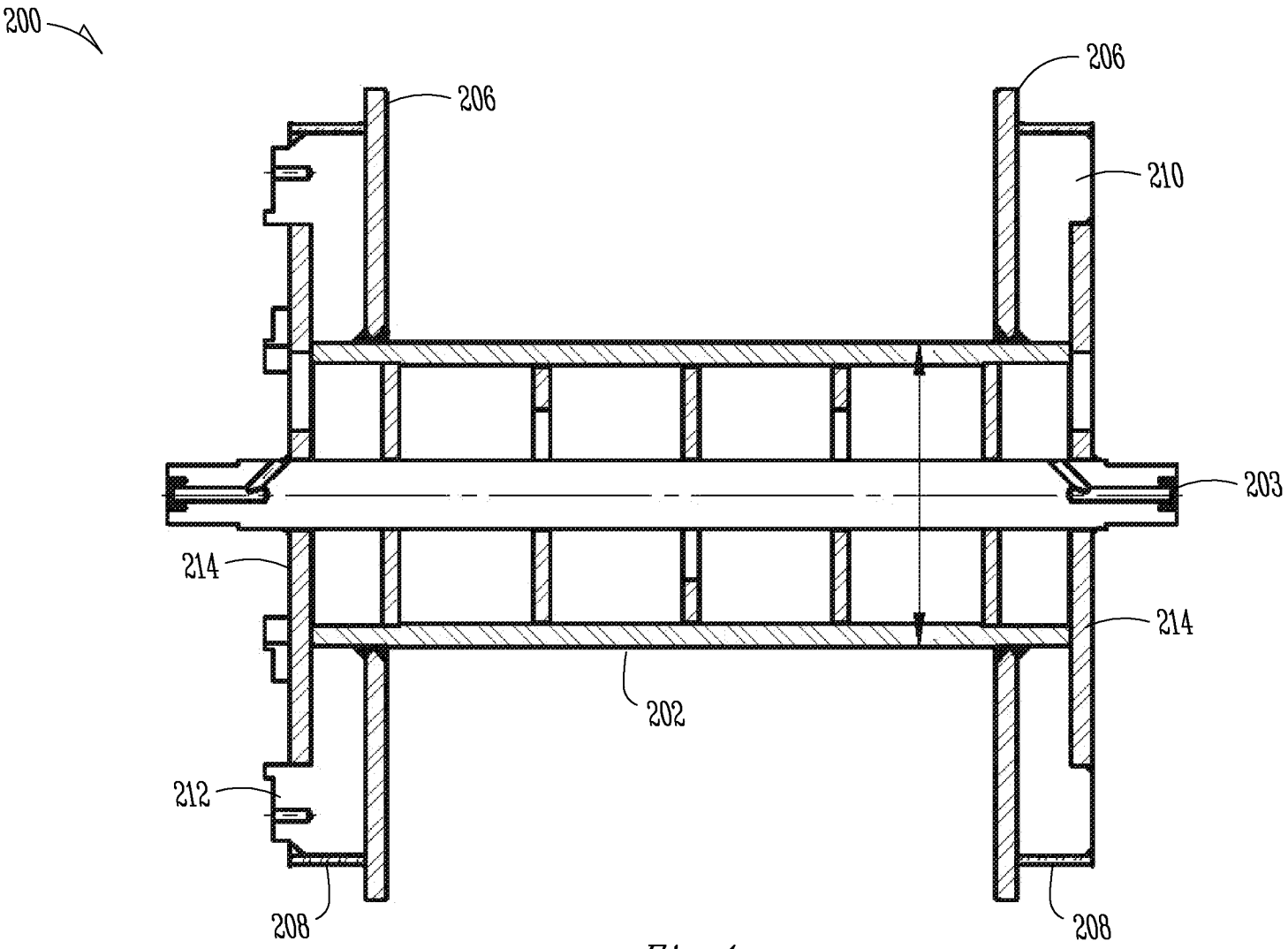
FIG. 4 is a cross-sectional view of the wireline drum of FIG. 2, according to one or more embodiments.

The flanges 204 may be coupled to the core 202 by welding. As shown for example in FIG. 4, two weld processes including a groove weld and an opposing fillet weld may be used to attach each flange 204. In particular, a first groove weld may be placed from a first side of each flange, and a second fillet weld may be placed from an opposing second side of each flange. It is to be appreciated, however, that it may be difficult to achieve complete joint penetration of the welds between the core and each flange or at least continuous uniform joint penetration. Placing the welds may require the core to be positioned on an end with a central axis arranged generally vertically. For each flange, placing a first weld may require that the core be positioned vertically on a first end, while placing a second weld may require flipping the core 180 degrees such that it is positioned on a second end. In order to ensure the flanges are square with the core, bracing may be used to align the flanges. For example, one, two, three, four, or more linear braces may be arranged between the flanges. In some embodiments, the brace(s) may be temporarily welded to the flanges, or otherwise temporarily fixed to the flanges to help align the flanges perpendicular to the core. A welder may need to repeatedly start and stop the welding process to avoid the bracing as welding is performed around the circumference of the core.

Figure 5:
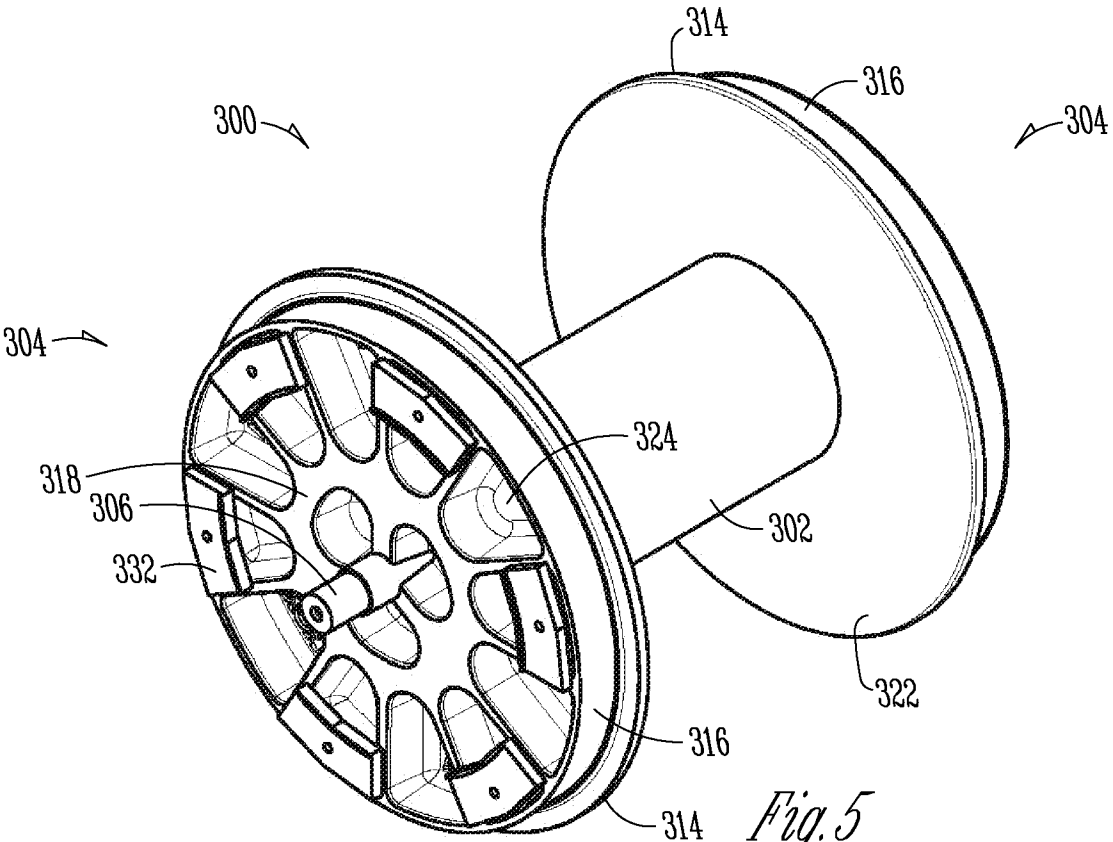
FIG. 5 is a perspective view of another wireline drum, according to one or more embodiments.
Figure 6:
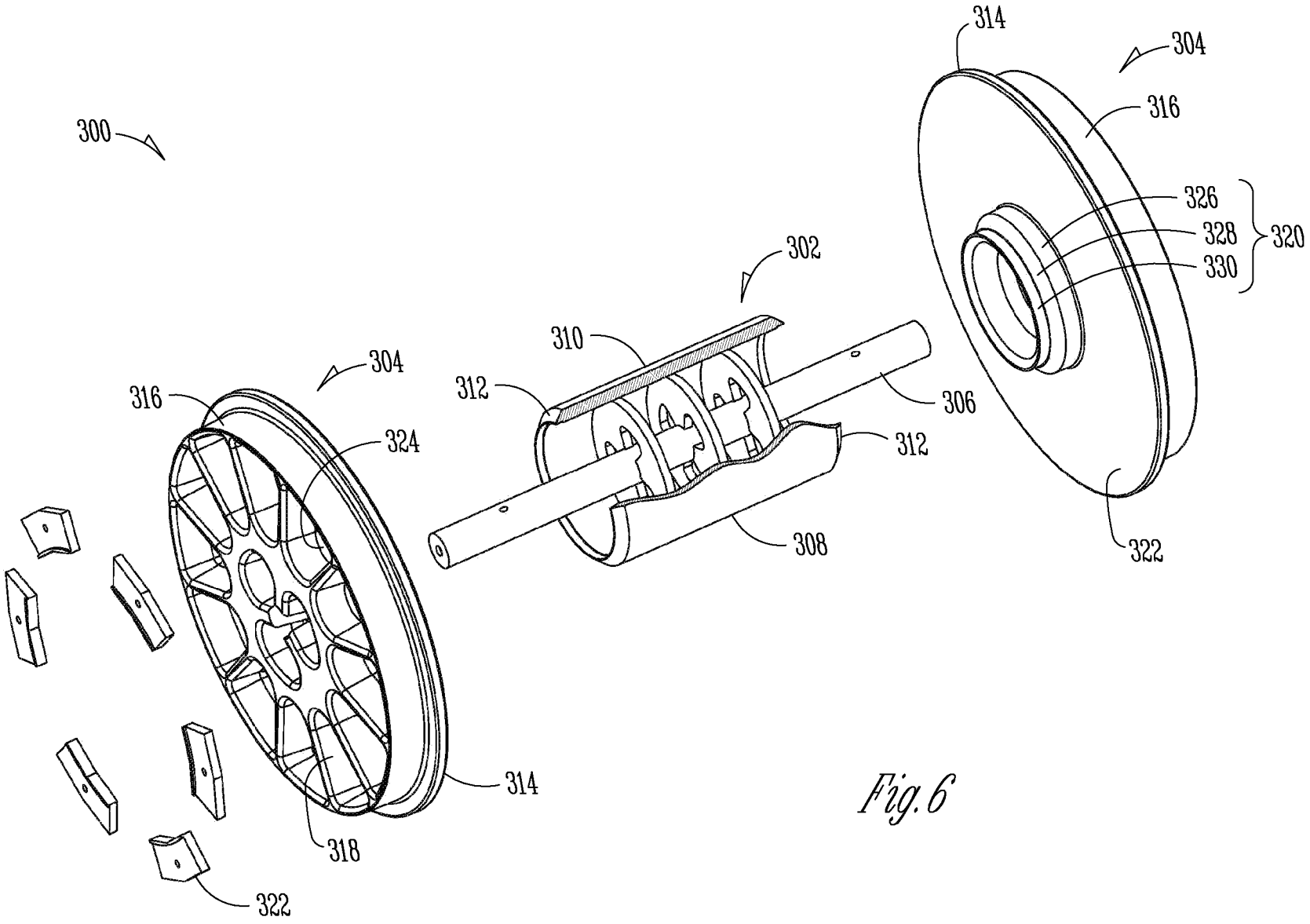
FIG. 6 is an exploded view of the wireline drum of FIG. 5, according to one or more embodiments.
Figure 7:
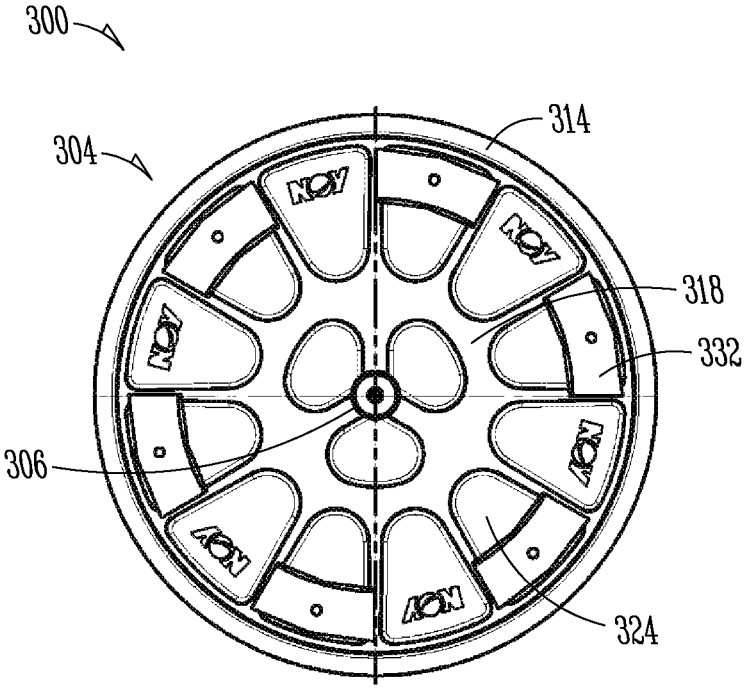
FIG. 7 is an end view of the wireline drum of FIG. 5, according to one or more embodiments.
Figure 8:
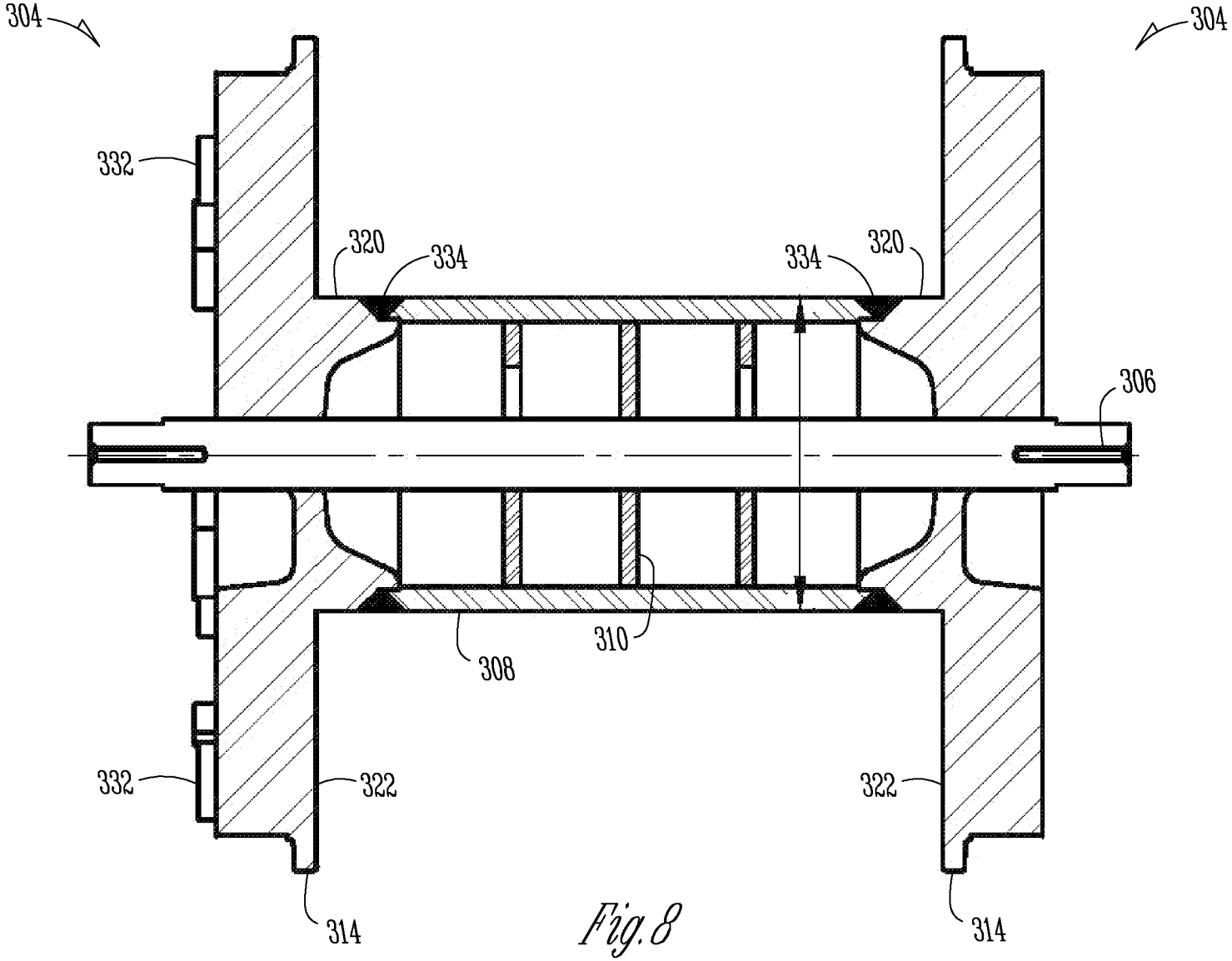
FIG. 8 is a cross-sectional view of the wireline drum of FIG. 5, according to one or more embodiments.

Turning now to FIG. 5, another wireline drum 300 is shown, according to one or more embodiments. FIGS. 6-8 show additional views of the wireline drum 300. The drum 300 may have a core 302 arranged between a pair of flanges 304. The drum 300 may be configured to receive a wireline spooled around the core 302. Additionally, the drum 300 may be configured for rotating at relatively high speeds to control a fastline portion of the wireline. The core 302 and flanges 304 may be arranged on a central shaft 306.

The core 302 may be sized and configured to receive the spooled wireline. The core 302 may have a cylindrical shape with an outer diameter of between approximately 14 inches and approximately 20 inches. In some embodiments, the core 302 may have an outer diameter of approximately 18 inches. The core 302 may have a different outer diameter in other embodiments. The core 302 may have a length perpendicular to its diameter and extending between first and second ends of the core, the length between approximately 12 inches and approximately 48 inches. In some embodiments, the core 302 may have a length of between approximately 18 inches and approximately 36 inches, or between approximately 24 and approximately 30 inches. In other embodiments, the core 302 may have any other suitable length. As shown in FIG. 6, the core 302 may include a cylindrical outer shell 308, which may define the diameter and length of the core. The outer shell 308 may have a central, longitudinal opening configured for receiving the central shaft 306. The outer shell 308 may have any suitable thickness extending between the outer diameter and an inner diameter. For example, the outer shell 308 may have a thickness of between approximately 0.5 inches and approximately 2 inches. In some embodiments, the outer shell 308 may be constructed from Schedule 120 pipe or Schedule 140 pipe. In other embodiments, the outer shell 308 may have any other suitable thickness.

In some embodiments, one or more inner stiffeners 310 may be arranged between the outer shell 308 and the central shaft 306. Each inner stiffener 310 may have a circular disk shape and may have a diameter sized such that the stiffener may be arranged within the outer shell 308. Each inner stiffener 310 may have a central opening sized for receiving the central shaft 306. In some embodiments, the core 302 may have 2, 3, 4, 5, or more inner stiffeners 310. In other embodiments, the core 302 may have more or fewer stiffeners 310. The inner stiffeners 310 may be evenly spaced along the length of the outer shell 308 so as to provide stiffening support to the outer shell.

In some embodiments, the core 302 may have a beveled or angled edge at one or both ends of the core. For example, as shown in FIG. 6, the outer shell 308 may have a beveled edge 312 at each of the first and second ends of the shell. From an outer surface of the outer shell 308, each beveled edge 312 may slope toward the central shaft 306 and toward the flange 304 arranged at that end of the core 302. Each beveled edge 312 may slope inward in this way at an angle of between approximately 15 degrees and approximately 75, or between approximately 30 degrees and approximately 60 degrees. In some embodiments, the beveled edge may slope toward the central shaft 306 at an angle of approximately 45 degrees. In one or more embodiments, the beveled edge may extend fully through the thickness of the core 302 or a nose may be provided such as a 1/16 inch or 1/8 inch nose, for example. In other embodiments, one or both edges 312 may slope toward a different direction and/or at a different angle. Moreover, in some embodiments, one or both edges 312 may have a different configuration or shape. For example, one or both edges 312 may have a groove or notch.

Each flange 304 of the drum 300 may configured to couple to an end of the core 302 so as to help maintain a spooled wireline on the core and/or to help maintain alignment of an extending wireline during spooling or unspooling. Each flange 304 may have a generally circular shape with a diameter larger than that of the core 302. For example, each flange 304 may have a diameter of between approximately 24 inches and approximately 72 inches. In particular embodiments, each flange 304 may have a diameter of approximately 24, 28, 30, 32, 36, 38, 42, 44, 48, 50, 52, or 54 inches. Each flange 304 may have a central opening configured for receiving the central shaft 306. In some embodiments, each flange 304 may have a disk portion 314, a brake ring 316, a brake gusset portion 318, and a neck 320.

The disk portion 314 may be configured to provide an extended surface perpendicular to the core 302 so as to maintain a position of a wireline spooled on the core. The disk portion 314 may have a flattened, circular shape with a diameter defining the diameter of the flange 304. For example, the disk portion 314 may have a diameter of approximately 24, 28, 30, 32, 36, 38, 42, 44, 48, 50, 52, or 54 inches in some embodiments. The disk portion 314 may have a first side or surface 322, which may be a core-facing surface. The disk portion 314 may further have a second side or surface 324, which opposes the core-facing surface 322 and faces away from the core when the flange is coupled to the core.

The brake ring 316 may extend from the second surface 324 of the disk portion 314. The brake ring 316 may have a circular shape and may be configured to receive a band brake for controlling rotational speed of the drum 300. The brake ring 316 may have a diameter smaller than, or in some embodiments equal to or approximately equal to, that of the disk portion 314. The brake ring 316 may have a width perpendicular to its diameter and extending laterally from the disk portion 314. The width may be sized to receive a band brake and may be between, for example, between approximately 2 inches and approximately 8 inches.

The brake gusset portion 318 may additionally extend from the second surface 324 of the disk portion 314. The brake gusset portion 318 may generally be arranged within a space defined by the second side 324 of the disk portion 314 and an inner surface of the brake ring 316. The brake gusset portion 318 may be configured to provide stiffening support to the brake ring 316. In some embodiments, the brake gusset portion 318 may include a plurality of spokes extending radially toward an inner surface of the brake ring 316. Each spoke may have a width extending from the second side 324 of the disk portion 314. The width of each spoke may be the same as, or approximately the same as, that of the brake ring 316. The brake gusset portion 318 may include a central opening configured to receive the central shaft 306. The brake gusset portion 318 may additionally include one or more other openings, which may be arranged about or adjacent the central opening for example, so as to help reduce weight and material of the brake gusset portion.

Figure 9:
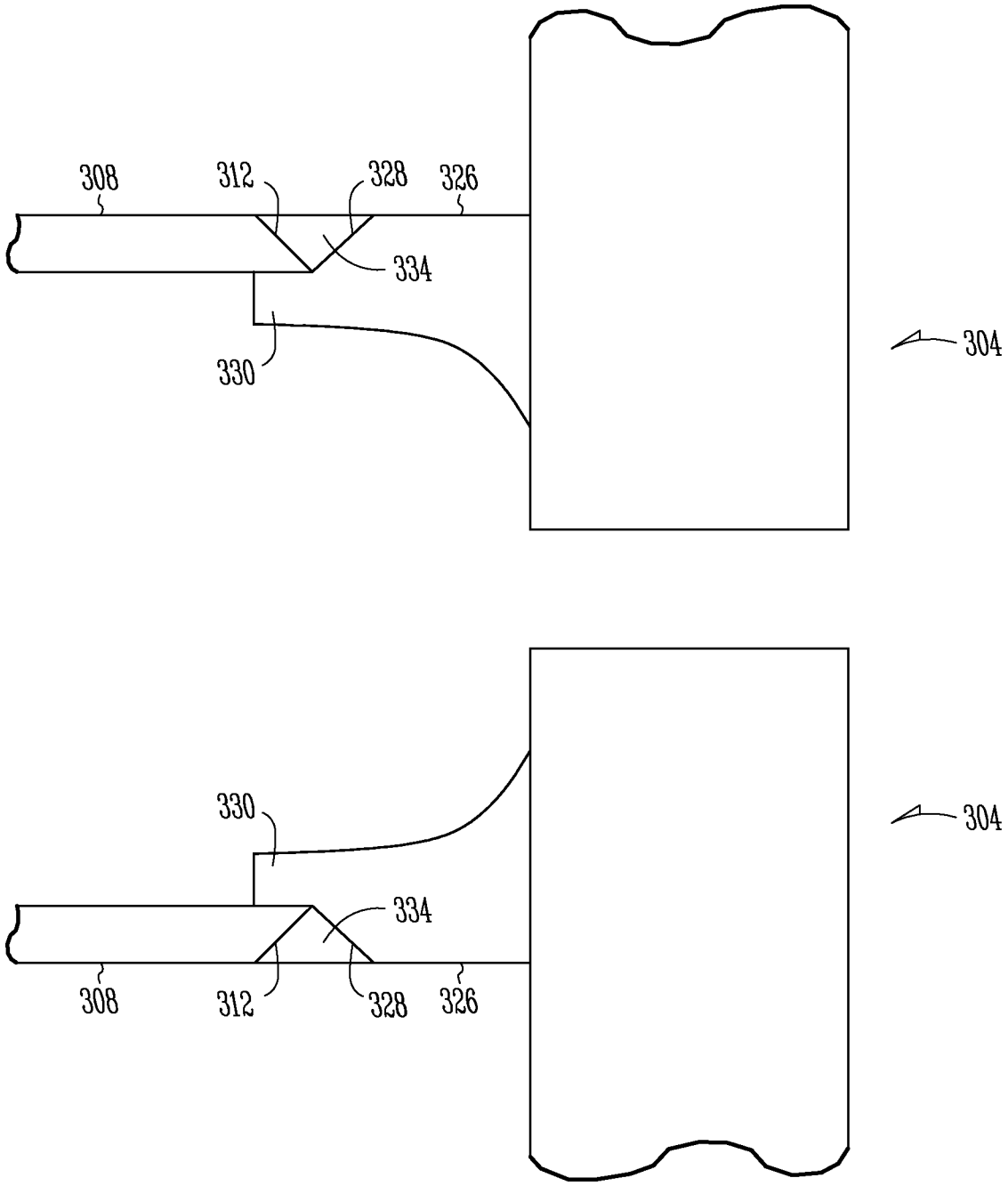
FIG. 9 is a cross-sectional view of a welded joint between a flange and a core of a wireline drum, according to one or more embodiments.

In some embodiments, each flange 304 may additionally have a neck 320 extending from the core-facing surface 322 of the disk portion 314. For each flange 304, the neck 320 may be configured to help position the flange with respect to the core 302 for welding, and may further be configured to align with the outer shell 308 so as to provide an extension of the core about which a wireline may be spooled. The neck 320 may have a circular shape and may extend laterally from the core-facing surface 322 of the disk portion 314 at an angle of approximately 90 degrees. The neck 320 may be centrally located on the core-facing surface 322 and may be configured to be arranged around the central shaft 306. The neck 320 may extend from the core-facing surface 322 and consideration may be given to the overall size of the flange 304 for purposes of casting the flange when determining the length of the neck. In one or more embodiments, the neck 320 may extend from the core-facing surface 322 a distance of between 2 inches and approximately 8 inches, or between approximately 3 inches and approximately 6 inches. In some embodiments, the neck 320 may extend from the core-facing surface 322 a distance of approximately 4⅝ inches. FIG. 9 shows a cross-section of the neck 320. As shown, the neck 320 may have a core extension surface 326, a beveled surface 328, and a lip 330.

The core extension surface 326 may have a same diameter as the outer shell 308 of the core 302, such that, when the flange 304 is coupled with the core 302, the extension surface may form an extension of the core about which a wireline may be spooled. The extension surface 326 may have a length perpendicular to its diameter, and extending between the core-facing surface 322 of the disk portion 314 and the beveled surface 328. The length of the extension surface 326 may be between approximately 8 inches, or between approximately 3 inches and approximately 6 inches. From the extension surface 326, the beveled surface 328 may slope inward toward the central shaft 306. The beveled surface 328 may slope toward the central shaft 306 at an angle of between approximately 15 degrees and approximately 75 degrees, or between approximately 30 degrees and approximately 60 degrees. In some embodiments, the beveled surface 328 may slope toward the central shaft 306 at an angle of approximately 45 degrees. From the beveled surface 328, the lip 330 may extend at an angle so as to be parallel with the extension surface 326. The lip 330 may be sized and configured to be arranged beneath the beveled edge 312 of the core 302 when the flange 304 is coupled to the core, as shown for example in FIG. 9. The lip may function as a backup bar for performing the weld between the flange 304 and the core 302. In this way, the lip 330 may have an outer diameter slightly smaller than an inner diameter of the outer shell 308. The lip 330 may have a length extending from the beveled surface 328 of between approximately 8 inches, or between approximately 3 inches and approximately 6 inches.

In some embodiments, each flange 304 may be cast as a single component. That is, a mold defining the disk portion 314, brake ring portion 316, brake gusset portion 318, and neck 320 may be filled with one or more molten metals and/or other materials for casting the flange 304 as a substantially single component. In this way, each flange 304 may be constructed without the need to weld, or otherwise attach, each of the disk portion 314, brake ring portion 316, brake gusset portion 318, and neck 320 together. Accordingly, the flange 304 and its constituent components may be a unitary element. That is, it may be free of joints, weld seams, or other connection features within the flange 304 and between the constituent components of the flange 304.

As shown in FIG. 6, In some embodiments, one or both flanges 304 may additionally have a plurality of sprocket gussets 332. Each sprocket gusset 332 may be coupled to the flange 304 and may be sized, shaped, and configured to provide a spacer for attaching a drive sprocket to the flange. Each sprocket gusset 332 may couple to the brake gusset portion 318 and/or the brake ring 316. For example, each sprocket gusset 332 may couple to a pair of spokes of the brake gusset portion 318, so as to be arranged substantially between a pair of spokes. The sprocket gussets 332 may be evenly spaced apart. In some embodiments, the sprocket gussets 332 may be independently welded, or otherwise coupled, to the cast flange 304. In this way, it is to be appreciated that flanges 304 with sprocket gussets 332 and flanges without sprocket gussets may be cast using a same mold. For example, where the sprocket gussets 332 are provided for only one of the two flanges 304 on a drum 300, the flanges may nevertheless be cast using a same mold. However, in other embodiments, the sprocket gussets 332 may be cast as part of the flange casting. That is, a casting mold for a flange 304 may include sprocket gussets 332 in some embodiments.

As shown in FIG. 9, when joined to form the drum 300, the beveled edges 312 of the core 302 may nest over or around the lip 330 of each flange 304. In particular, the core 302 may be positioned such that each beveled edge 312 is arranged over or on the lip 330 of the corresponding flange 304. Thus, each beveled edge 312 may be arranged adjacent the beveled surface 328 of a flange 304. Each beveled edge 312 and adjacent beveled surface 328 may slope or slant in opposing directions, such that a V-shaped groove is formed between each beveled edge and adjacent beveled surface. This V-shaped groove may be configured to receive a weld 334, as shown for example in FIG. 8. As further shown in FIG. 8, when the core 302 and flanges 304 are jointed together, an outer surface of the core 302 may align with the extension surface 326 of each flange 304, such that the extension surfaces each form an extension of the core. For each flange 304, the weld 334 may bridge the gap between the outer shell 308 and the extension surface 328.

Thus, it is to be appreciated that the welds 334 for joining the flanges 304 with the core 302 may each be effectively arranged at a point along the core itself, rather than at a corner between core and flange disk portion. That is, by casting the flanges 304 to include an extension of the core 302 (i.e. to include the neck 320), and arranging a weld between each of those extensions and the core, the drum 300 may be constructed without the need for two weld processes at the location of the disk portion 314, such as that shown in FIG. 4. Additionally, the V-groove welds 334 may provide for complete joint penetration between the core 302 and flanges 304, whereas complete joint penetration may be more difficult and/or time consuming to achieve with the two welds shown in FIG. 4. The location of the welds 334 may be relatively easily accessible, as opposed to welds located at 90-degree corner between flange disk portion and core. Moreover, the welds 334 may be performed with a longitudinal axis of the drum 300 arranged substantially horizontal. That is, it is to be appreciated that the welds 334 may be completed without a need to position the drum 300 on end. The location and relatively low complexity of the welds 334 additionally may allow for the use of a robotic or automated welding apparatus in placing the welds.

In some embodiments, the welds 334 may be arranged at a different location along the length of the core 302. It is to be appreciated that with the welds 334 arranged along a length of the core 302 at generally any suitable location, rather than at a 90-degree corner between the core and each flange disk portion 314, the same benefits may be realized. For example, for each flange 304, a length of the neck 320, including a length of the extension surface 326, may be increased and a length of the core 302 between beveled edges 312 may be reduced. The welds 334 may thus be arranged further from the disk portions 314 and nearer to a center of the drum 300 in some embodiments. In one or more embodiments, a two-piece approach to assembling the drum may be used and the core 302 may be omitted altogether. That is, the neck 320 may be welded directly to a neck of the opposing flange.

It is to be further appreciated that the nesting or mating of the necks 320 with the core 302 may help to align or position the flanges 304 with respect to the core. In particular, the extension of the lip 330 of each flange 304 beneath a corresponding beveled edge 312 of the core 302 may help to align or square the flange with respect to the core. This may allow for assembling the drum 300 without the need for bracing.

Figure 10:
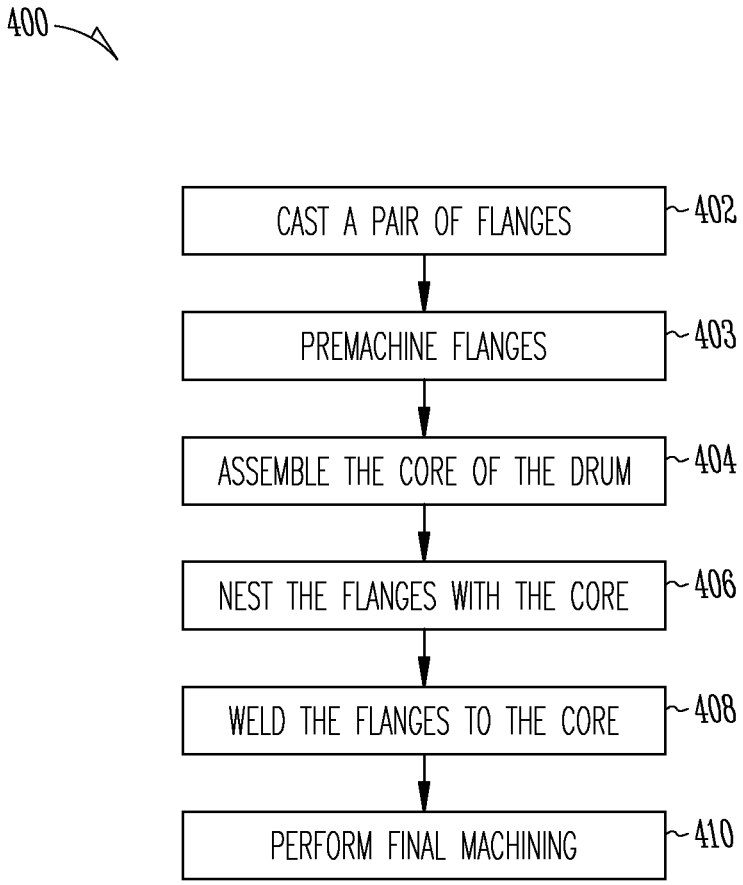
FIG. 10 is a flow diagram of a method of manufacturing a wireline drum, according to one or more embodiments.

Turning now to FIG. 10, a method 400 of manufacturing a wireline drum of the present disclosure is shown, according to one or more embodiments. The method 400 may generally include the steps of casting the flanges 402; premachining the flanges 403; assembling the core 404; for each flange, nesting the flange with the core 406; for each flange, welding the flange to the core 408; and final machining 410. In other embodiments, the method 400 may include additional and/or alternative steps.

Casting the flanges 402 may include casting each flange as a solid component using a mold. Casting a flange as substantially a single element may require less time, labor, and fewer tools than constructing a flange having a plurality of individually coupled components. In particular, by casting the flange as a single component, rather than assembling a plurality of small pieces to achieve the same structure, manufacturing time for the drum may be reduced by up to 50%, or up to 75%. Additionally, in some embodiments, both flanges for a drum may be cast using a same mold. This may help to reduce time and cost for manufacturing the drum. The flanges may be cast using any suitable metal(s) and/or other materials. Casting may allow a manufacturer to have control over the material(s) employed in constructing the flanges. For example, a flange may be cast with materials configured to have relatively high or improved yield strength and/or machinability, as compared with conventional or other off-the-shelf flange components. Each cast flange may include a disk portion, a brake ring, a brake gusset portion, and a neck. As described above, sprocket gussets may be added to one or both flanges if desired to accommodate a drive mechanism. In some embodiments, premachining may be performed on the flange 403 after casting.

Assembling the core 404 may include arranging the one or more inner stiffeners within the outer shell. The inner stiffeners may be evenly spaced and welded or otherwise secured in place within the shell.

Nesting each flange with the core 406 may include, for each flange, placing the flange adjacent the core, such that a beveled edge of the core extends over the lip of the flange neck. When aligned in this way, a V-shaped groove may be formed between the beveled edge and the beveled surface of the flange neck. A weld may then be placed within this V-shaped groove to weld the flange to the core 408. It is to be appreciated that the lip of the flange neck may operate as a backing bar for the V-groove weld. Filler material for the weld may include steel and/or any other suitable metals or other materials. For each flange, the weld may be placed while a longitudinal axis of the core and flange is positioned substantially horizontally. In some embodiments, the weld for each flange may be completed in substantially one pass by rotating the core and flange. In some embodiments, the weld may be achieved by a robotic or automated welding arm. However, in other embodiments, the weld may be completed by a human welder. In some embodiments, both flanges may be aligned with the core simultaneously or consecutively and welded simultaneously or consecutively. In other embodiments, a first flange may be positioned and welded before a second flange is positioned and welded.

The method 400 may include a final machining step 410, which may include cleaning the core and removing any excess or undesired material. Such machining may be performed with the drum arranged on a lathe in some embodiments.

It is to be appreciated that steps of the method 400 may be performed in parallel or concurrently, and the flowchart of FIG. 10 should be read in the context of the various embodiments of the present disclosure. In addition, the order of the method steps described and illustrated herein may be rearranged for some embodiments. Similarly, the method 400 could have additional steps or fewer steps or operations than those shown in FIG. 10.

Wireline drums of the present disclosure, and methods of manufacturing the same, may provide for a variety of improvements over conventional drums and manufacturing methods. As described above, a wireline drum of the present disclosure may be constructed in a fraction of the time that may typically be needed to manufacture conventional wireline drums. Additionally, a drum of the present disclosure may be relatively more customizable. For example, by casting the flanges, design variations and different sizes and configurations may be constructed as desired using different casting molds. Additionally, materials and material properties of flanges may be selected as desired to achieve particular benefits. This provides an improvement over other flanges that may be constructed with stock components. Moreover, by casting the flanges to have a neck welds may be effectively located along the core itself, rather than at the corners between core and disk portion. By effectively positioning the welds along the core, the welds may be positioned to experience lower stress. This may help to avoid placing welds at relatively high stress locations on the drum. A drum of the present disclosure may therefore be more durable and/or resistant to cracking or otherwise failing welds, as compared with conventional wireline drums having, for example, double fillet welds or a V-grove weld at the core/disk corners.

Wireline drums of the present disclosure also provide for an improvement over fully cast drums. Other wireline drums that are cast as a single component (i.e. where the core and two flanges are cast as one piece) may present size and scale challenges. It may be difficult and/or cost prohibitive to cast a wireline drum as a single piece beyond a particular size. In contrast, by casting the flanges independently and welding them to the core, as described above, a wireline drum of the present disclosure may be constructed in a wider variety of sizes with relative ease and cost effectively.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A wireline drum configured for receiving a spooled wireline, the drum comprising:

a core having a first diameter and configured for receiving a wireline spooled thereon; and a pair of cast flanges, each flange arranged at an end of the core and comprising:

a disk portion having a second diameter larger than the first diameter and having a first side and a second side;

a neck extending from the first side of the disk portion toward the core;

a brake ring arranged on the second side; and a brake gusset portion arranged within the brake ring and on the second side and comprising a central opening and one or more other openings adjoining the central opening.

2. The wireline drum of claim 1, further comprising a weld arranged between the core and each flange neck.

3. The wireline drum of claim 1, wherein the neck of each flange comprises an extension surface having a diameter equal to the first diameter.

4. The wireline drum of claim 3, wherein the neck of each flange further comprises a beveled surface extending from the extension surface and a lip extending from the beveled surface.

5. The wireline drum of claim 4, wherein the core comprises a beveled edge arranged at each of two ends of the core, and wherein a weld is arranged between the beveled surface of each flange neck and an adjacent beveled edge of the core.

6. A method of manufacturing a wireline drum, the method comprising:

assembling a core, the core having a first diameter and configured for receiving a wireline spooled thereon;

casting a pair of flanges, each flange comprising:

a disk portion having a second diameter larger than the first diameter and having a having a first side and a second side;

a neck extending from the first side of the disk portion;

a brake ring arranged on the second side; and a brake gusset portion arranged within the brake ring and on the second side and comprising a central opening and one or more other openings adjoining the central opening; and welding each flange to the core by placing a weld between the core and each neck portion.

7. The method of claim 6, wherein the neck of each flange comprises an extension surface having a diameter equal to the first diameter.

8. The method of claim 7, wherein the neck of each flange further comprises a beveled surface extending from the extension surface and a lip extending from the beveled surface.

9. The method of claim 8, wherein the core comprises a beveled edge arranged at each of two ends of the core, and wherein the weld is arranged between the beveled surface of each flange neck and an adjacent beveled edge of the core.

10. The method of claim 8, wherein for each flange, the lip provides a backing bar for the weld.

11. A handling system comprising:

at least one of a crown sheave or stuffing box sheave, arranged over a well so as to direct a line toward the well;

a wireline cable extending around the at least one of a crown sheave or stuffing box sheave, the wireline cable configured for coupling to a downhole tool; and a wireline drum configured for spooling and unspooling the wireline cable to control movement of the downhole tool, the wireline drum comprising:

a core having a first diameter adapted for having the wireline cable spooled thereon; and a pair of cast flanges, each flange arranged at an end of the core and comprising:

a disk portion having a second diameter larger than the first diameter and having a first side and a second side;

a neck extending from the first side of the disk portion toward the core;

a brake ring arranged on the second side; and a brake gusset portion arranged within the brake ring and on the second side and comprising a central opening and one or more other openings adjoining the central opening.

12. The handling system of claim 11, wherein the wireline drum comprises a weld arranged between the core and each flange neck.

13. The handling system of claim 11, wherein the neck of each flange comprises an extension surface having a diameter equal to the first diameter.

14. The handling system of claim 13, wherein the neck of each flange further comprises a beveled surface extending from the extension surface.

15. The handling system of claim 14, wherein the beveled surface extends from the extension surface at an angle of approximately 45 degrees.

16. The handling system of claim 14, wherein the neck of each flange further comprises a lip extending from the beveled surface.

17. The handling system of claim 16, wherein the core nestably engages with the lip of each flange neck.

18. The handling system of claim 14, wherein the core comprises a beveled edge arranged at each of two ends of the core.

19. The handling system of claim 18, wherein each beveled edge comprises a bevel angle of approximately 45 degrees.

20. The handling system of claim 18, wherein a V-shaped groove is formed between each beveled edge and the beveled surface of an adjacent flange.

* * * * *